United States Patent [19]

Freed, Jr.

[11] 4,056,189

[45] Nov. 1, 1977

[54] MATERIAL GATHERING DEVICE FOR A MINING MACHINE

[75] Inventor: Donald L. Freed, Jr., Belleville, Ill.

[73] Assignee: National Mine Service Company, Pittsburgh, Pa.

[21] Appl. No.: 643,856

[22] Filed: Dec. 23, 1975

[51] Int. Cl.[2] ..... B65G 65/06

[52] U.S. Cl. ..... 198/514; 198/518; 299/56; 299/67

[58] Field of Search ..... 198/9, 36, 103; 299/43–46, 56, 64, 65, 67, 68, 18; 198/512, 514, 515, 518, 608

[56] References Cited

U.S. PATENT DOCUMENTS

| | | | |
|---|---|---|---|
| 2,575,287 | 11/1951 | Myers | 198/9 |
| 3,417,851 | 12/1968 | Gonski et al. | 198/9 |
| 3,620,345 | 11/1971 | Gonski | 198/9 |
| 3,774,969 | 11/1973 | Lebegue | 299/64 |
| 3,817,579 | 6/1974 | Delli-Gatti | 299/68 |

*Primary Examiner*—Evon C. Blunk
*Assistant Examiner*—Joseph E. Valenza
*Attorney, Agent, or Firm*—Stanley J. Price, Jr.; John M. Adams

[57] ABSTRACT

A mining machine for dislodging solid material from a mine face includes a body portion mounted on endless tracks and a boom member extending forwardly from the body portion with a cutter drum member rotatably mounted on the front end of the boom member. An endless conveyor mechanism is positioned in a longitudinal trough member and conveys dislodged material from the front of the mining machine. A gathering platform extends forwardly from the body portion and the conveyor mechanism and is positioned rearwardly of the cutter drum member. A plurality of rotatably mounted gathering disc members are positioned rearwardly of the forward transverse edge portion on the gathering platform. The gathering discs include a first pair of large discs that are positioned oppositely of the longitudinal axis of the conveyor mechanism. A second pair of smaller gathering discs are positioned laterally of the large gathering discs adjacent the lateral edge portions of the conveying platform. A drive mechanism mounted on the gathering platform is drivingly connected to the gathering discs so that the small gathering discs rotate in a direction opposite to the corresponding large gathering discs. The dislodged material is directed onto the gathering platform and is fed by the small gathering discs onto the large gathering discs and therefrom into the trough member and onto the conveyor mechanism. The gathering discs may be driven by a single motor connected to a large disc with the remaining discs connected by meshing spur gears. In another embodiment, each of the large discs may be driven by separate motors with drive trains connecting the small discs to the respective motors.

9 Claims, 9 Drawing Figures

MATERIAL GATHERING DEVICE FOR A MINING MACHINE

BACKGROUND OF THE INVENTION

1. Field of the Invention

This invention relates to a device for gathering material dislodged by the cutting action of a mining machine and more particularly to a plurality of gathering discs rotatably mounted on a gathering device and rotated through a drive mechanism for conveying the dislodged material onto the conveyor mechanism of the mining machine.

2. Description of the Prior Art

Continuous mining machines employed in underground mining operations include a pair of boom members that extend forwardly from the mining machine frame and carry a pair of arm members that are mounted adjacent opposite sides of the center line of the machine. By operation of hydraulically controlled piston cylinder assemblies, the arm members are arranged to pivot about a transverse axis of the machine. A rotatable mining head, generally comprising a driven cutter drum, as illustrated in U.S. Pat. Nos. 3,712,678 and 3,774,969, is rotatably mounted transversely on the forward ends of the supporting arms. An endless conveying chain extends longitudinally along the center line of the machine in a trough member and includes a discharge end that is mounted on a swing support. The receiving end of the conveying mechanism is positioned between the support arms and is operatively associated with a gathering device.

The gathering device includes a gathering platform that extends transversely across the front of the machine and tapers rearwardly to the receiving end portion of the conveying mechanism as disclosed in U.S. Pat. Nos. 2,703,344 and 3,328,087. The gathering arms illustrated in U.S. Pat. No. 3,328,087 are rotatably mounted adjacent the transverse forward edge portion of the gathering platform and rotate in opposite directions to convey the dislodged material rearwardly from the gathering platform onto the receiving end of the conveyor as the mining machine advances.

A problem is encountered with conventional gathering devices on wide-type continuous mining machines that form an entryway in excess of 15 feet. The gathering arms are not effective in feeding the dislodged material across the expanded width of the entryway from the gathering platform to the conveyor. The material that is deposited on the gathering platform beyond the reach of the gathering arms collects jamming the arms and eventually terminating the conveying operation until the jam is cleared. There is need for a gathering device on wide-type continuous mining machines that provides uninterrupted conveyance of the dislodged material from the gathering platform onto the longitudinal conveyor of the mining machine.

SUMMARY OF THE INVENTION

This invention relates to a material gathering device for a mining machine that includes a gathering platform extending forwardly from the mining machine. The gathering platform has a forward transverse edge portion and rearwardly converging side portions. A first pair of gathering disc members are rotatably positioned on the gathering platform adjacent the transverse edge portion. A second pair of gathering disc members are rotatably positioned on the gathering platform laterally of the first pair of gathering disc members respectively and adjacent the side portions. A drive mechanism is positioned on the gathering platform and is operable to rotate the gathering disc members with adjacent disc members rotating in opposite directions. A drive train connects the drive mechanism with the gathering disc members so that the disc members rotate to convey dislodged material from the gathering platform rearwardly on the mining machine.

In one embodiment of the present invention, the drive mechanism includes a pair of electric or hydraulic motors that are positioned rearwardly and on opposite sides of the gathering platform. An angle drive mechanism connects each of the motors to the first pair of gathering disc members having a diameter greater than the second pair of gathering disc members. The respective angle drive mechanisms are connected by drive shafts to a worm drive mechanism for each of the large gathering discs to thereby transmit rotation to the large gathering discs. A spur gear is secured to the periphery of the lower surface of each of the large gathering discs and is arranged is meshing relation with a spur gear secured, in a similar manner, to the periphery of the corresponding second pair of gathering disc members. With this arrangement, rotation of the large gathering discs is transmitted to the small gathering discs. The dislodged material picked up by the forward transverse edge portion of the gathering platform is fed by the rotating small gathering discs to the large gathering discs and therefrom onto the mining machine conveyor that moves the material rearwardly on the mining machine.

In an additional embodiment of the present invention, the spur gears of the large gathering discs are arranged in meshing relation with each other on the longitudinal axis of the mining machine conveyor. A single motor on the gathering platform is drivingly connected to one of the large gathering discs so that rotation thereof is transmitted by the meshing spur gears to the other large gathering disc. The small gathering discs are, in turn, positioned in meshing relation with the respective large gathering discs so that rotation is transmitted from the respective large gathering discs to the small gathering discs.

A single drive motor may be employed to rotate the gathering disc members in which the gathering discs are removed from meshing relation and are rotatably supported on the gathering platform by worm drive mechanisms. Rotational movement is transmitted from the single drive motor by an angle drive mechanism and an output shaft to each of the worm drive mechanisms of the large gathering discs. A transfer drive mechanism connects the output shaft of the angle drive mechanism to an input shaft that is drivingly connected to each of the worm drive mechanisms of the small gathering discs. With this arrangement, each of the gathering disc members is drivingly connected to the output shaft of the single drive motor.

Accordingly, the principle object of the present invention is to provide a gathering device for rearwardly conveying dislodged material onto the conveyor mechanism of a continuous mining machine in which a plurality of gathering discs are rotatably positioned on a gathering platform and are driven by drive mechanisms provided on the gathering platform to rotate the discs and thereby feed the dislodged material onto the conveyor.

Another object of the present invention is to provide a gathering device for a continuous mining machine to feed dislodged material onto the mining machine conveyor by the rotation of gathering disc members that are rotatably positioned and suitably driven on the gathering platform.

A further object of the present invention is to provide a drive mechanism for generating rotational movement through a drive train to a plurality of material gathering disc members positioned on a gathering platform that extends forwardly of a continuous mining machine for transferring dislodged material onto the mining machine conveyor.

Another object of the present invention is to provide a material gathering device for a wide-type continuous mining machine in which pairs of driven gathering discs are positioned on the gathering platform so that the dislodged material is conveyed from the platform onto the mining machine conveyor by the rotating action of the gathering discs.

These and other objects of the present invention will be more completely disclosed and described in the following specification, the accompanying drawings and the appended claims.

DESCRIPTION OF THE PREFERRED EMBODIMENTS

Figure 1:
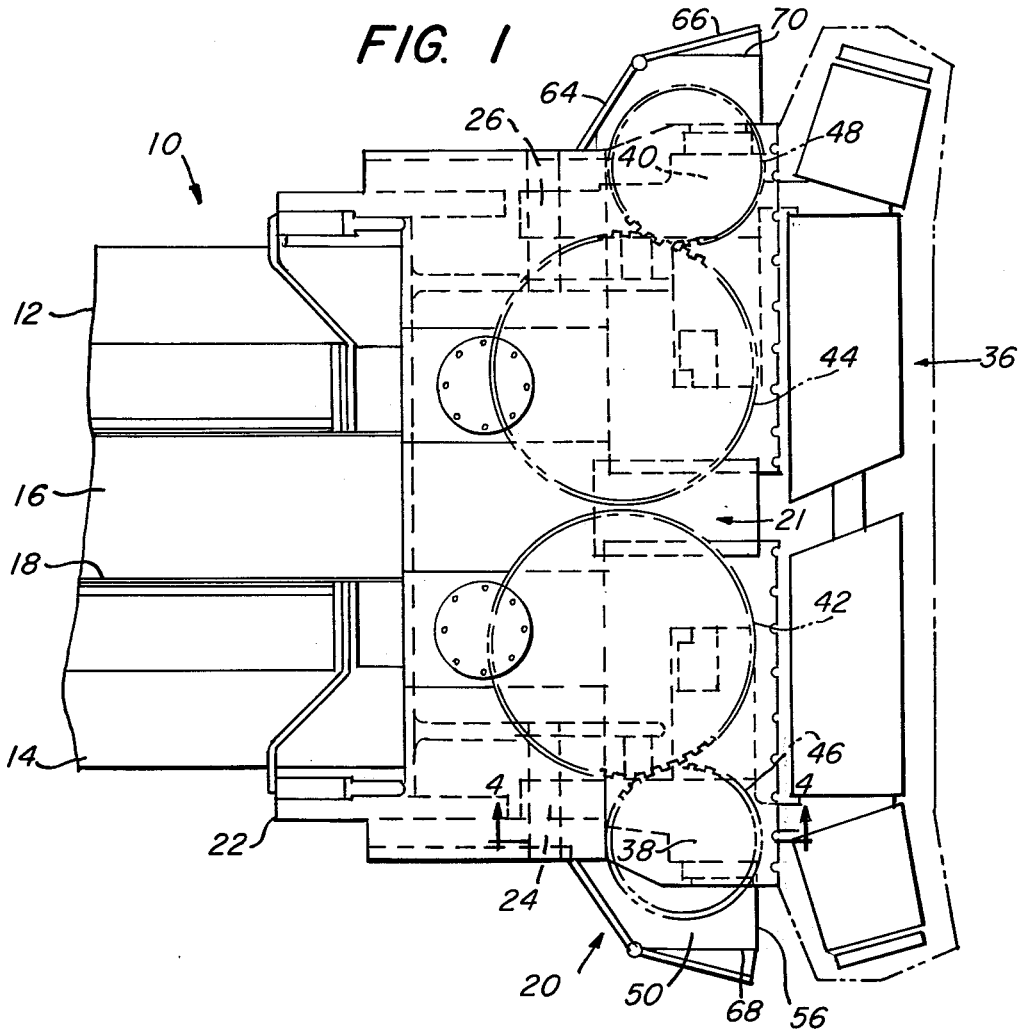
FIG. 1 is a top plan view of the forward portion of a mining machine, illustrating the cutter drum positioned in overlying relationship to and extending beyond the gathering device having a plurality of driven gathering disc members positioned thereon.

Referring to the drawings and particularly FIGS. 1–4, there is illustrated the forward portion of a continuous mining machine generally designated by the numeral 10 that has a body or frame portion 12 suitably mounted on endless crawler tracks 14. Hydraulic motors (not shown) are provided to propel the mining machine 10 on the endless crawler tracks 14 to advance the mining machine during the mining operation. An endless conveyor mechanism 16 is positioned in a longitudinal trough member 18 and conveys dislodged material therein from the front of the mining machine to a rear discharge section (not shown). A gathering device generally designated by the numeral 20 extends forwardly from the body portion 12. A plurality of gathering disc members generally designated by the numeral 21 are rotatably supported and driven in accordance with the practice of the present invention to gather the dislodged material and feed the dislodged material onto the conveyor trough 18 so that the dislodged material may be conveyed rearwardly by the endless conveyor mechanism 16 to the discharge section.

Figure 2:
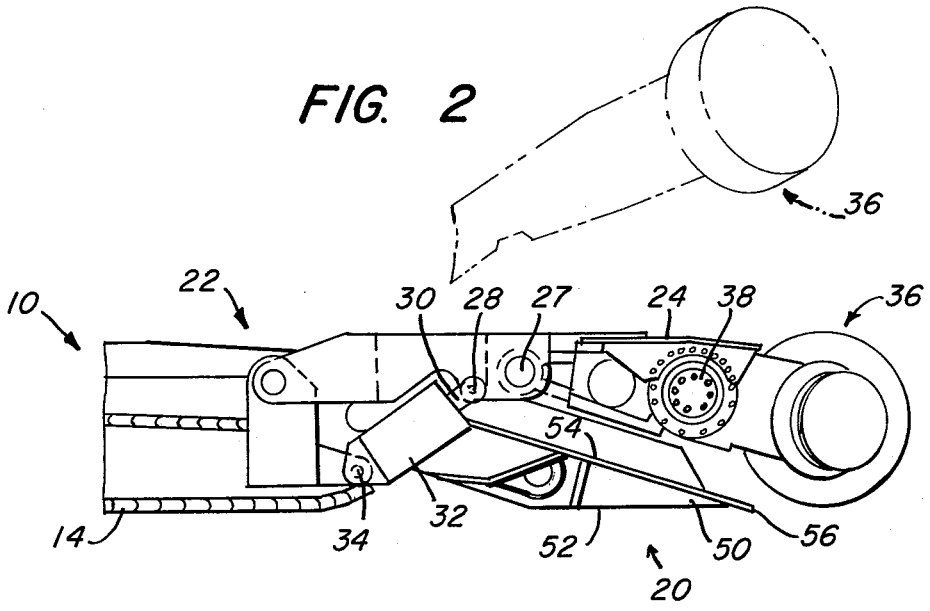
FIG. 2 is a fragmentary view in side elevation of the mining machine shown in FIG. 1, illustrating in phantom the relative movement of the cutter drum with respect to the gathering device.

A forwardly extending boom member 22 includes a pair of parallel arm members 24 and 26 that are pivotally connected at pivot point 27 at their rear end portions to the boom member 22. The arm members 24 and 26 are also connected, as illustrated in FIG. 2, at pivot point 28 to a piston rod 30 of a piston cylinder assembly 32. The piston cylinder assemblies 32 are, in turn, pivotally connected to the mining machine body portion at pivot point 34. The arm members 24 and 26 rotatably support at their forward end portions a cutter drum member generally designated by the numeral 36. Drum rotating motors 38 and 40 are supported by the boom arm members 24 and 26. The motors 38 and 40 may be either electrically or hydraulically operated and are suitably connected through clutch and drive gearing mechanisms to the cutter drum 36.

The piston cylinder assemblies 32 are operable upon actuation to pivot the boom arm members 24 and 26 about the pivot point 28 to move the boom member 22 and the drum member 36 vertically for an upward or a downward cut of the mine face. The material dislodged in this manner is fed onto the gathering device 20 by the forward advancement of the mining machine 10. The gathering device 20 includes gathering disc members 42, 44, 46, and 48 that are rotatably supported on a gathering platform 50 and are driven in a manner to be later explained to rearwardly convey dislodged material into the conveyor trough member 18. The cutter drum member 36 for dislodging the material from the mine face is not included within the scope of the present invention and is referred to for only purposes of illustration; therefore, the gathering device 20 of the present invention may be associated with any conventional device for dislodging solid material from a mine face.

Figure 3:
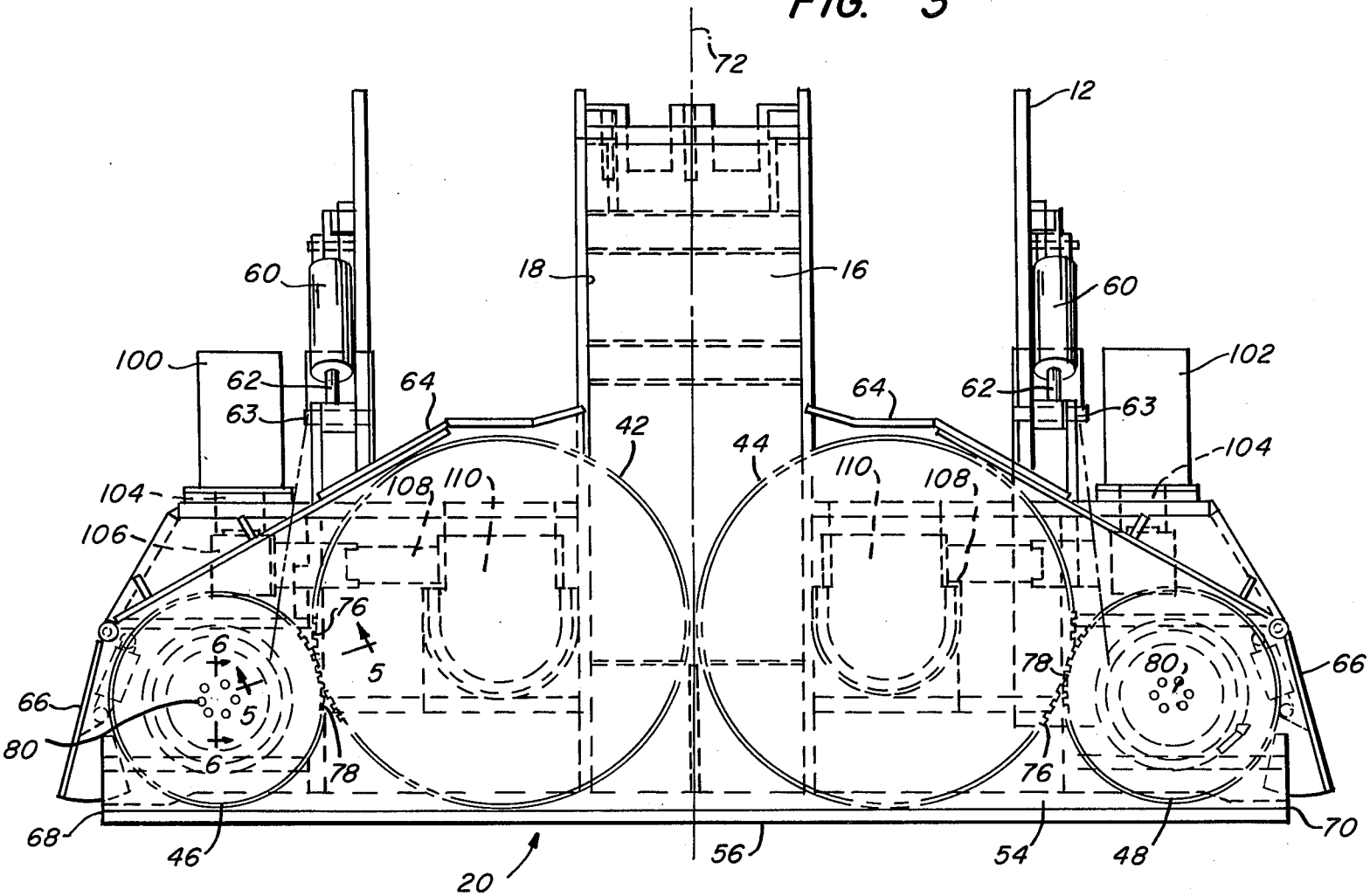
FIG. 3 is an enlarged fragmentary top plan view of the gathering device for gathering material dislodged by the cutter drum member and feeding the dislodged material onto a longitudinally extending conveyor, illustrating a pair of large gathering discs arranged in meshing relation with a pair of small gathering discs respectively.
Figure 4:
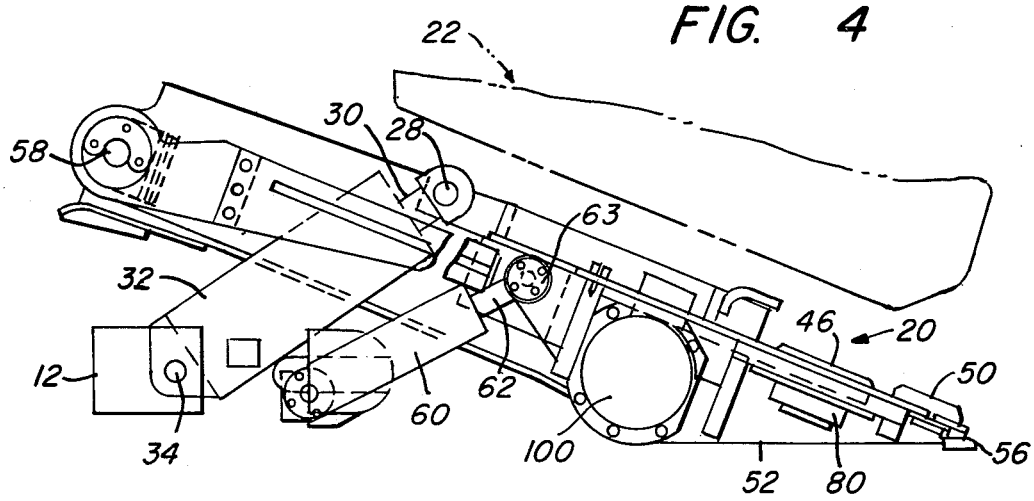
FIG. 4 is a fragmentary sectional view taken along line 4—4 of FIG. 1, illustrating the gathering device pivotally connected for vertical movement on the front of the mining machine.

As illustrated in FIGS. 2 and 3, the gathering platform 50 includes a ground engaging lower horizontal surface 52 that is arranged to advance on the mine floor. The gathering platform 50 has an inclined upper surface 54 that terminates with the lower horizontal surface 52 in a forward edge portion 56 that extends transversely across the front end of the mining machine 10 and is positioned rearwardly and below the cutter drum member 36. As illustrated in FIG. 4, the gathering platform 50 extends rearwardly of the forward transverse edge portion 56 and is pivotally connected at its rearward end portion 58 to the mining machine body portion 12. A pair of piston cylinder assemblies 60 are positioned laterally of the gathering platform 50 and are pivotally connected at their end portions to the body portion 12 and include extensible piston rods 62. The piston rods 62 are secured at their end portion 63 intermediately of the gathering platform 50. Suitable means (not shown) are provided to supply hydraulic fluid under pressure to the piston cylinder assemblies 60 to extend and retract the piston rods 62 and thus raise and lower the gathering platform 50 relative to the mine floor.

As illustrated in FIGS. 1 and 3, vertical plate members 64 extend upwardly from the peripheral edges of the rearward end portion of the gathering platform 50. Forwardly extending vertical plate members 66 abut the plate members 64 and extend laterally adjacent side edge portions 68 and 70 of the gathering platform 50. With this arrangement, the plate members 64 and 66 serve to direct the dislodged material onto the gathering platform 50 and toward the conveyor trough member 18.

Referring to FIGS. 1 and 3, the gathering device 20 has a first pair of large gathering disc members 42 and 44 that are rotatably supported on the surface of the gatheringplatform 50. The peripheral edge portions of the gathering discs 42 and 44 are positioned adjacent the longitudnal axis 72 of the conveyor mechanism 16 in overlying relation with the trough member 18 at the forward end portion thereof. The periphery of the discs 42 and 44 are also positioned adjacent the forward edge portion 56 of the gathering platform 50 and the vertical plate members 64. The discs 42 and 44 have an upper conveying surface 74 that is maintained at substantially the level of the upper surface 54 of the gathering platform 50 to form a planar surface across which the dislodged material is fed toward the conveyor trough member 18.

Figure 5:
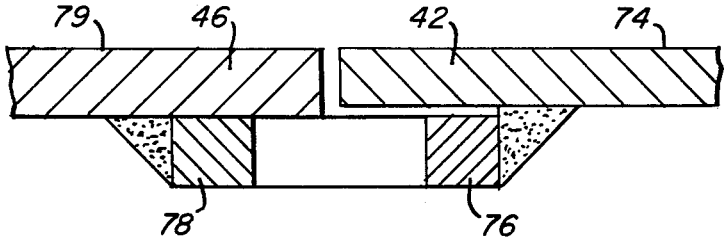
FIG. 5 is a fragmentary sectional view taken along line 5—5 of FIG. 3, illustrating the meshing gear teeth secured to the periphery of the large and small disc members and positioned below the surface of the gathering platform.

A spur gear 76 is secured to the lower peripheral edge of each of the gathering discs 42 and 44. The spur gear 76 of each of the gathering discs 42 and 44 are, in turn, arranged in meshing relation with spur gears 78 that are secured to the periphery of the smaller gathering discs 46 and 48. The gathering discs 46 and 48 are positioned laterally of the discs 42 and 44 with the peripheral edge portions positioned adjacent the forward edge portion 56 and the plate members 64 and 66. The meshing relationship of the respective spur gears 76 and 78 for the gathering discs 42 and 46 is illustrated in FIG. 5. The teeth of the spur gears 76 and 78 mesh at the point of tangency of the respective gathering discs 42 and 46. The upper surface 79 of disc 46 is positioned at the elevation of surface 74 of disc 42 to form a planar surface across which material is fed. The spur gears of the gathering discs are positioned below the gathering platform upper surface 54 and are therefore protected from dislodged material passing into contact with the gear teeth and jamming the rotating gathering discs. Thus with this arrangement rotation of the gathering discs 42 and 44 is transmitted to the respective gathering discs 46 and 48 by the meshing engagement of the spur gears 76 and 78 secured to the lower peripheral surface of each of the gathering discs.

Figure 6:
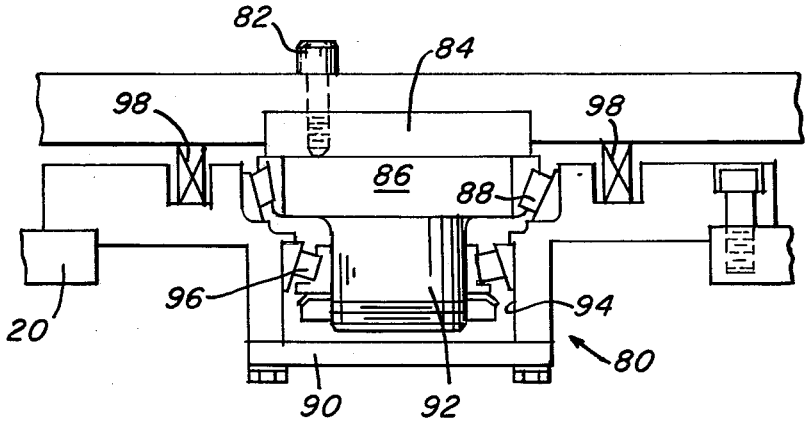
FIG. 6 is a fragmentary sectional view taken along line 6—6 of FIG. 3, illustrating the apparatus for rotatably supporting a small gathering disc member on the gathering platform.

The smaller gathering discs 46 and 48 are rotatably supported on the gathering device 20 by a bearing assembly 80 as illustrated in FIG. 6. The gathering disc 46 is secured by suitable fastener means such as bolts 82 to the end of an idler shaft 84. The idler shaft 84 has an enlarged diameter portion 86 that is rotatably supported by roller bearings 88 on a bearing carriage 90. The bearing carriage 90 is rigidly secured to the gathering platform 50. A small diameter end portion 92 of idler shaft 84 extends downwardly within a recess 94 of the bearing carriage 90 and is rotatably supported therein by roller bearings 96. Suitable grease seals 98 seal the openings to the bearing carriage 90 between the lower surface of the gathering disc 46 and the upper flanged portion of the bearing carriage 90. Thus with this arrangement, the gatheering discs 46 and 48 are rotatably supported on the gathering platform 50. Rotation of the gathering discs 42 and 44 is then transmitted by the meshing spur gears 76 and 78 to the gathering discs 46 and 48.

As illustrated in FIGS. 3 and 4, a pair of drive mechanisms such as motors 100 and 102, which may be either electrically or hydraulically operated, are mounted on the gathering device 20 rearwardly of the gathering platform 50. A drive shaft 104 of each of the motors 100 and 102 is connected to a conventional angle drive mechanism 106. A through shaft 108 extends from the angle drive mechanism 106 and is drivingly connected to a worm drive mechanism 110 of each of the gathering discs 42 and 44. Actuation of motors 100 and 102 rotates drive shafts 104, and rotation thereof is transmitted by the angle drive mechanisms 106 and the through shafts 108 to the worm drive mechanisms 110 of the gathering discs 42 and 44. Transmission of rotation to the worm drive mechanisms 110 preferably rotates the gathering disc 42 in a counterclockwise direction and gathering disc 44 in a clockwise direction.

Rotation of the gathering devices 42 and 44 is transmitted through the meshing spur gears 76 and 78 to the respective gathering discs 44 and 46 to rotate the discs in a direction opposite to that of the respective discs 42 and 44. With this arrangement of providing separate drive motors 100 and 102 for the gathering disc combinations 42-46 and 44-48, the dislodged material that is directed onto the forward edge portion 56 of the gathering device 20 is conveyed into the conveyor trough member 18. The smaller gathering discs 44 and 46 operate to continuously feed the dislodged material from the lateral portions of the gathering platform 50 onto the larger gathering discs 44 and 46. The gathering discs 44 and 46, rotating in opposite directions, feed the dislodged material into the trough member 18 and onto the conveyor mechanism 16. In this manner, the dislodged material is conveyed rearwardly to the discharge section of the mining machine 10.

Figure 7:
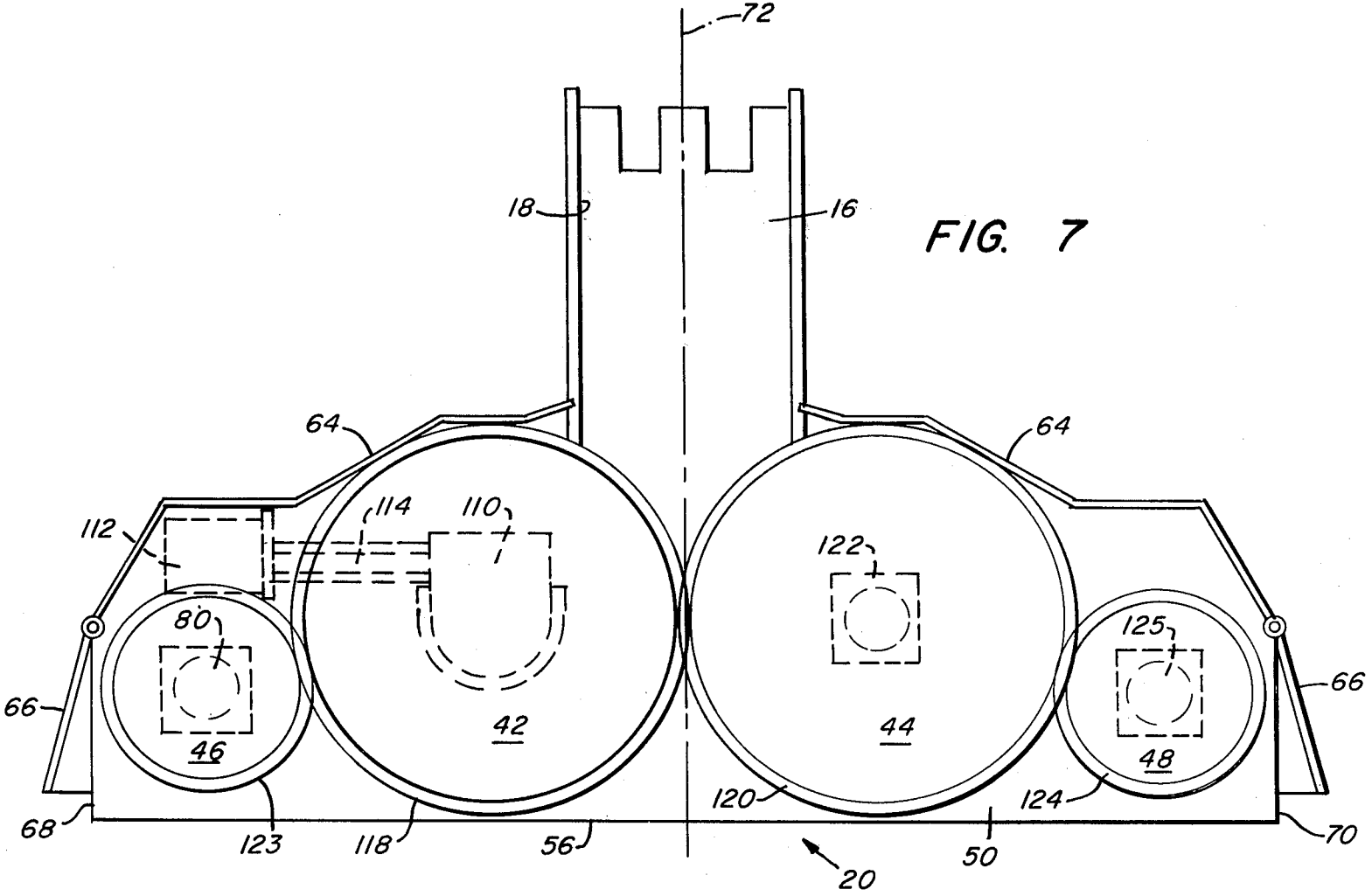
FIG. 7 is a fragmentary top plan view of the gathering device, schematically illustrating the large and small gathering disc members arranged in meshing relation in which a single drive motor rotates a selected one of the large gathering disc members.

A further embodiment for rotating the gathering discs of the gathering device 20 is illustrated in FIG. 7 in which a single drive mechanism 112, such as the motors 100 and 102, is mounted on the gathering platform 50 and includes an output shaft 114. The output shaft 114 is drivingly connected to a worm drive mechansim 116 of gathering disc 42. Operation of the motor 112 rotates the output shaft 114 which transmits rotation through the worm drive mechanism 116 to the gathering disc 42. A spur gear 118 secured to the periphery of gathering disc 42 meshes on the conveyor longitudnal axis 72 with a spur gear 120 secured to the periphery of gathering disc 44. The gathering disc 44 is, in turn, rotatably supported on the gathering platform 50 by a bearing assembly 122 which is identical to the bearing assembly 80 for supporting the discs 46 and 48 on the platform 50 as illustrated in FIG. 6. Thus, counterclocckwise rotation of gathering disc 42 is transmitted by the meshing gears 118 and 120 to rotate disc 44 in a clockwise direction.

Rotation of the gathering disc 42 is transmitted by the meshing of spur gear 118 of disc 42 with the spur gear 123 of disc 46 to rotate disc 46 opposite to that of disc 42. As described hereinabove the gathering disc 46 is rotatably supported on the gathering platform 50 by the bearing assembly 80. The teeth of spur gear 120 on gathering disc 44 mesh with the teeth of a spur gear 124 that is secured to the lower peripheral surface of the gathering disc 48. The gathering disc 48 is, in turn, rotatably supported by a bearing assembly 125 on the gathering platform 50 so that rotation of disc 44 is transmitted through the meshing gears 120 and 124 to disc 48. Thus, clockwise rotation of the gathering disc 44 generates counteclockwise rotation of gathering disc 48. With the discs 46 and 48 rotating oppositely to discs 42 and 44, the dislodged material picked up by the discs 46 and 48 is conveyed onto the discs 42 and 44. The discs 42 and 44 are arranged to rotate in a preselected direction on the gathering platform 50 so that the material picked up by the forward edge portion 56 and fed directly to the discs 42 and 44 is conveyed rearwardly into the trough member 18. The material beyond the periphery of the discs 46 and 48 on the platform 50 is fed by the discs 46 and 48 onto the discs 42 and 44. In this manner, material is prevented from jamming on the platform 50. Accordingly, the material is deposited into the conveyor trough member 18 and moved rearwardly by the conveyor mechanism 16 to the discharge section of the mining machine.

Figures 8, 9:
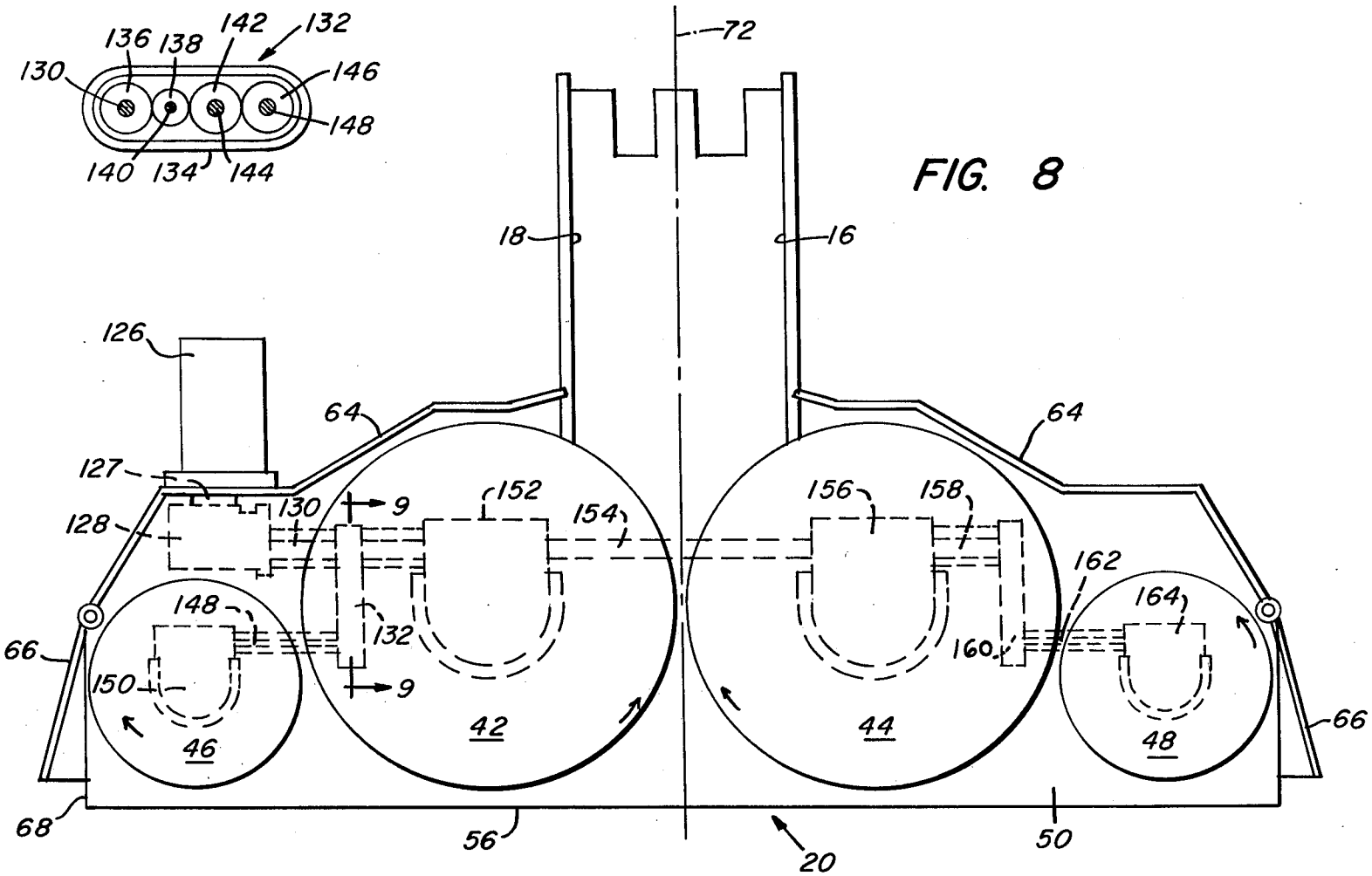
FIG. 8 is a view similar to FIG. 7, schematically illustrating a single drive motor for rotating a selected one of the large gathering disc members with the remaining discs drivingly connected thereto by a drive arrangement for rotating the discs to feed the dislodged material from the gathering platform onto the longitudinal conveyor.
FIG. 9 is a sectional view taken along line 9—9 of FIG. 8, schematically illustrating the drive arrangement for transferring rotation from the single drive motor to the small gathering disc members of the gathering device as shown in FIG. 8.

Referring to FIG. 8, there is illustrated a further embodiment of the gathering disc drive arrangement in which a single drive mechanism, such as an electrically or hydraulically operated motor 126, is mounted on the gathering platform 50. The motor 126 has a drive shaft 127 that is drivingly connected to an angle drive mechanism 128 of the type described above and illustrated in FIG. 3. The angle drive mechanism 128 transmits rotation from the motor 126 through an output shaft 130 to a drive transfer mechanism 132. The drive transfer mechanism 132 is illustrated in detail in FIG. 9 and includes a casing 134 in which is contained a helical gear 136 that is nonrotatably secured to the output shaft 130. The helical gear 136 meshes with a helical gear 138 on shaft 140. The helical gear 138, in turn, is arranged in meshing relation with helical gear 142 on shaft 144. The helical gear 142 is drivingly connected to helical gear 146 having an output shaft 148 nonrotatably secured thereto. With this arrangement, rotation of the output shaft 130 is transmitted through the meshing helical gears 136, 138, 142, and 146 to the output shaft 148. The output shaft 148 is drivingly connected to a worm drive mechanism 150 that rotatably supports the gathering disc 46. Thus, rotation produced by the motor 126 is transferred by the trasnfer drive mechanism 132 to the gathering disc 46.

The output shaft 130 of the angle drive mechansim 128 extends through the casing 134 of the transfer drive mechansim 132 and is drivingly connected to a worm drive mechanism 152 of the gathering disc 42. The worm drive mechanism 152 rotatably supports the gathering platform 50 so that the output of the motor 126 is transmitted to the gathering disc 42 to rotate the disc preferably in a countercockwise direction. Rotation of the output shaft 130 is transmitted from the worm drive mechanism 152 to a drive shaft 154 and therefrom to a worm drive mechanism 156. The worm drive mechansim 156 rotatably supports the gathering disc 44 on the gathering platform 50. With this arrangement, the gathering disc 44 is rotated in a clockwise direction on the gathering platform 50.

Rotation from the worm drive mechanism 156 is transmitted by an output shaft 158 to a transfer drive mechanism 160 that is identical to the transfer drive mechanism 132 described hereinabove. By the meshing arrangement of the helical gears of the transfer drive mechanism 160, rotation of output shaft 158 is transmitted to an input shaft 162 that is drivingly connected to a worm drive mechanism 164. The worm drive mechanism 164 rotatably supports the gathering disc 48 on the gathering platform 50. With this arrangement, rotation to the gathering disc 44 is transmitted to the gathering disc 48 to rotate the gathering disc 48 in a clockwise direction. Thus, with the gathering disc drive arrangement illustrated in FIG. 8, a single motor 126 transmits rotation to the gathering discs 42 and 44; and by the respective transfer drive mechanisms 132 and 160, rotational movement is transmitted to the gathering discs 46 and 48. Further, as stated hereinabove, the positioning of the gathering discs 46 and 48 adjacent to the gathering discs 42 and 44 and rotating oppositely of discs 42 and 44 function to continually feed the material dislodged by the cutting action of the drum member 36 from the forward edge portion 56 and gathering platform 50 onto the gathering discs 42 and 44 and therefrom into the trough member 18 and onto the conveyor mechanism 16.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A material gathering device for a mining machine comprising, a gathering platform extending forwardly from the mining machine, said gathering platform having a transverse forward edge portion and side portions extending rearwardly therefrom, a longitudinal conveyor extending rearwardly from said gathering platform, said conveyor being operable to convey dislodged material rearwardly from said gathering platform on the mining machine, a first set of gathering disc members rotatably positioned in side by side relation on one side of said longitudinal conveyor adjacent said forward edge portion of said gathering platform, a second set of gathering disc members rotatably positioned in side by side relation on the opposite side of said longitudinal conveyor adjacent said forward edge portion of said gathering platform, said first set and said second set of gathering disc members each including a first gathering disc positioned oppositely of said longitudinal conveyor and a second gathering disc positioned adjacent said side portion of said gathering platform, said first and second gathering discs having peripheral edge portions positioned tangentially to one another, drive means positioned on said gathering platform for rotating said first and second sets of gathering disc members, gear means for drivingly connecting said drive means with said first and second sets of gathering disc members and transmitting rotation from said first gathering disc to said second gathering disc, said gear means secured to said peripheral edge portions of said first and seccond gathering discs so that said gear means of said gathering discs are maintained in meshing relation and said gathering disc members of each of said sets rotate in opposite directions to convey dislodged material laterally from said gathering platform onto said longitudinal conveyor.

2. A material gathering device for a mining machine as set forth in claim 1 which includes, a trough member positioned on said gathering platform and extending rearwardly from said forward transverse edge portion thereof, said longitudinal conveyor being retained in said trough member for feeding dislodged material rearwardly from said gathering platform on the mining machine, said first and second set of gathering disc members each including a first gathering disc positioned oppositely of said longitudinal conveyor in overlying relation therewith and a second gathering disc positioned adjacent said side portion of said gathering platform, and said drive means being operable to rotate said first gathering disc in a direction opposite to the direction of rotation of said second gathering disc of said first and second sets of gathering disc members such that dislodged material is fed laterally from said second gathering disc to said first gathering disc and therefrom onto said longitudinal conveyor.

3. A material gathering device for a mining machine as set forth in claim 1 which includes, said drive means including a motor mounted adjacent said first gathering disc, an output shaft extending from said motor, means for drivingly connecting said output shaft to said first gathering disc to transmit rotation from said output shaft to said first gathering disc, and gear means nonrotatably secured to said first and second gathering discs for transmitting rotation from said first gathering disc to said second gathering disc.

4. A material gathering device for a mining machine as set forth in claim 3 which includes, said gear means including spur gear members nonrotatably secured to and positioned below said first and second gathering discs, said gear means of said first gathering disc arranged in meshing relation with said gear means of said second gathering disc, and bearing means for rotatably supporting said second gathering disc on said gathering platform.

5. A material gathering device for a mining machine as set forth in claim 1 which includes, said drive means including a motor mounted on said gathering platform, an output shaft extending from said motor, means for drivingly connecting said output shaft to a selected one of said first gathering discs to transmit rotation from said output shaft to one of said first gathering discs, first gear means nonrotatably secured to said first gathering discs of said first and second sets of gathering disc members for transmitting rotation between said first gathering discs, second gear means nonrotatably secured to said second gathering discs of said first and second sets of gathering disc members, and said second gear means positioned in meshing relation with said first gear members for transmitting rotation from said first gathering discs to said second gathering discs.

6. A material gathering device for a mining machine as set forth in claim 1 which includes, said drive means including a single motor mounted on said gathering platform, an output shaft extending from said motor, means for drivingly connecting said output shaft to each of said first gathering discs to transmit rotation from said output shaft to said first gathering discs, transfer gear means for drivingly connecting said output shaft to each of said second gathering discs to transmit rotation from said output shaft to said second gathering discs, and said seccond gathering discs each being rotatable in a direction opposite to the rotation of said first gathering discs so that the dislodged material is fed from said second gathering disc to said first gathering disc of said first and second set of gathering disc members.

7. A material gathering device for a mining machine as set forth in claim 6 which includes, said transfer gear means including a plurality of meshing helical gears, one of said meshing helical gears nonrotatably secured to said output shaft, and an input shaft drivingly connected to each of said second gathering discs and another of said meshing helical gears to thereby transmit rotation from said output shaft to each of said second gathering discs.

8. A material gathering device for a mining machine as set forth in claim 1 which includes, said first and second sets of gathering disc members each having an upper conveying surface, and said first and second sets of gathering disc members rotatably supported on said gathering platform such that said upper conveying surfaces form a substantially planar surface with the surface of said gathering platform to facilitate the continuous conveying of dislodged material thereacross.

9. A material gathering device for a mining machine as set forth in claim 1 which includes, said gathering platform pivotally connected at the rearward end portion thereof to the mining machine, and piston cylinder means connected at one end portion to said gathering platform and at the other end portion to the mining machine for raising and lowering said gathering platform relative to the ground.

* * * * *